US007123226B2

(12) United States Patent
Ham

(10) Patent No.: US 7,123,226 B2
(45) Date of Patent: Oct. 17, 2006

(54) METHOD OF MODULATING DATA SUPPLY TIME AND METHOD AND APPARATUS FOR DRIVING LIQUID CRYSTAL DISPLAY DEVICE USING THE SAME

(75) Inventor: Yong Sung Ham, Kyounggi-do (KR)

(73) Assignee: LG.Philips LCD Co., Ltd., Seoul (KR)

( * ) Notice: Subject to any disclaimer, the term of this patent is extended or adjusted under 35 U.S.C. 154(b) by 425 days.

(21) Appl. No.: 10/606,858

(22) Filed: Jun. 27, 2003

(65) Prior Publication Data

US 2004/0100433 A1 May 27, 2004

(30) Foreign Application Priority Data

Nov. 27, 2002 (KR) ..... 10-2002-0074366

(51) Int. Cl.
*G09G 3/36* (2006.01)

(52) U.S. Cl. ..... 345/89; 345/690

(58) Field of Classification Search ..... 345/87–104, 345/690

See application file for complete search history.

(56) References Cited

U.S. PATENT DOCUMENTS

| | | | | |
|---|---|---|---|---|
| 5,495,265 | A | 2/1996 | Hartman et al. | |
| 5,844,533 | A * | 12/1998 | Usui et al. | 345/89 |
| 6,556,180 | B1 * | 4/2003 | Furuhashi et al. | 345/87 |
| 2002/0024481 | A1 * | 2/2002 | Kawabe et al. | 345/87 |

FOREIGN PATENT DOCUMENTS

| | | | |
|---|---|---|---|
| JP | 06046357 | A * | 2/1994 |
| WO | WO 99/055678 | | 11/1999 |

* cited by examiner

*Primary Examiner*—Alexander Eisen
(74) *Attorney, Agent, or Firm*—McKenna Long & Aldridge LLP

(57) ABSTRACT

A method of modulating data supply time includes steps of deriving a light transmittance versus time characteristic during a change of each gray level to another gray level in a liquid crystal display panel, deriving a transition time when each gray level is changed to another gray level on a basis of light transmittance versus time characteristic, and modulating a supply time of data supplied to the liquid crystal display panel in accordance with the transition time.

14 Claims, 7 Drawing Sheets

DATA VARIATION WHEN APPLY ING THIS INVENTION

VARIATION OF BRIGHTNESS CHARACTERISTIC WHEN APPLYING THIS INVENTION

VARIATION OF BRIGHTNESS CHARACTERISTIC UPON NORMAL DRIVE

DATA VARIATION UPON NORMAL DRIVE

METHOD OF MODULATING DATA SUPPLY TIME AND METHOD AND APPARATUS FOR DRIVING LIQUID CRYSTAL DISPLAY DEVICE USING THE SAME

The present invention claims the benefit of Korean Patent Application No. P2002-74366 filed in Korea on Nov. 27, 2002, which is hereby incorporated by reference.

BACKGROUND OF THE INVENTION

1. Field of the Invention

The present invention relates to a liquid crystal display device, and more particularly to a method and apparatus for driving a liquid crystal display.

2. Description of the Related Art

In general, liquid crystal display (LCD) devices control light transmittance of individual liquid crystal cells in accordance with a video signal to displaying image. For example, an active matrix LCD device includes thin film transistors formed at each liquid crystal cell for displaying moving images.

As shown in equations 1 and 2, a response time of an LCD device is slow due to inherent physical characteristics of liquid crystals, such as viscosity and elasticity.

$$\tau_r \propto \gamma d^2/\Delta\epsilon|V^2_a - V^2_F| \quad (1)$$

wherein, $\tau_r$ represents a rising time when a voltage is supplied to the liquid crystals, Va is a supplied voltage, $V_F$ is Freederic transition voltage at which liquid crystal molecules begin to perform an inclined motion, d is a cell gap of the liquid crystal cells, and γ represents a rotational viscosity of the liquid crystal molecules.

$$\tau_f \propto \gamma d^2/K \quad (2)$$

wherein, $\tau_f$ represents a falling time at which the liquid crystals returned to an initial position by elastic restoring force after a voltage supplied to the liquid crystals is removed, K is the inherent elastic constant of the liquid crystals, and γ represents a rotational viscosity of the liquid crystal molecules.

Twisted nematic (TN) mode liquid crystals may have different response times due to physical characteristics of the liquid crystal material and a cell gap. For example, the TN mode liquid crystals commonly have a rising time of about 20 to 80 ms and a falling time of about 20 to 30 ms. Since the liquid crystals have a response time longer than one frame interval, i.e., 16.67 ms, in a NTSC system, of a motion picture, a voltage charged within the liquid crystal cell progresses to the next frame prior to arriving at a target voltage. Therefore, the motion blurring phenomenon in which the screen image of the motion picture is blurred out would be caused.

FIG. 1 is a waveform diagram of brightness variation in accordance with data in a liquid crystal display according to the related art. In FIG. 1, since a display brightness BL corresponding to a data VD cannot achieve a desired brightness due to slow response speed when the data VD is changed from one level to another level, an LCD device cannot display desired color and brightness. Accordingly, a motion-blurring phenomenon appears when images are in motion, and display quality deteriorates due to a reduction in contrast ratio. In order to overcome the slow response time, several devices have been developed. For example, U.S. Pat. No. 5,495,265 and PCT International Publication No. WO 99/055678, which are hereby incorporated by reference, have suggested modulating data in accordance with a presence or absence of change in the data by using a look-up table, i.e., high-speed driving method. The high-speed driving method allows the data to be modulated as shown in FIG. 2. For example, U.S. Pat. No. 5,495,265 and PCT International Publication No. WO 99/055678, which are hereby incorporated by reference, have suggested modulating data in accordance with a presence or absence of change in the data by using a look-up table, i.e., high-speed driving method. The high-speed driving method allows the data to be modulated as shown in FIG. 2.

FIG. 2 is a waveform diagram of brightness variation in accordance with data modulation in a high-speed driving method according to the related art. In FIG. 2, a high-speed driving method modulates input data VD and supplies the modulated data MVD to a liquid crystal cell, thereby obtaining a desired brightness MBL. The high-speed driving method increases proportionally according to the term $|V_a^2 - V_F^2|$ from Equation 1, wherein response time of the liquid crystals reduces rapidly. Accordingly, the LCD device employing such a high-speed driving method compensates for the slow response time of the liquid crystals by modulating the data value in order to alleviate a motion-blurring phenomenon in moving images, thereby displaying images having undesirable color and brightness.

FIG. 3 is a diagram representing an example of the high speed driving method using 8-bit data according to the related art. In FIG. 3, the high-speed driving method detects a variation in most significant bit data through a comparison of most significant bit data MSB of a current frame Fn with most significant bit data MSB of a previous frame Fn−1. If the variation in the most significant bit data MSB is detected, a modulated data corresponding to the variation is selected from a look-up table so that the most significant bit data MSB is modulated. The high-speed driving method modulates only a part of the most significant bits among the input data for reducing the memory capacity when implemented as hardware.

FIG. 4 is a block schematic diagram of a high-speed driving apparatus according to the related art. In FIG. 4, a high-speed driving apparatus includes a frame memory 43 connected to a most significant bit output bus line 42 and a lookup table 44 connected to the most significant bit output bus line 42 and an output terminal of the frame memory 43.

The frame memory 43 stores most significant bit data MSB for one frame period and supplies the stored data to the lookup table 44. Generally, the most significant bit data MSB are high-order 4 bits among 8 bits of the source data RGB.

The lookup table 44 makes a mapping of the most significant bit data of the current frame Fn input from the most significant bit output bus line 42 and the most significant bit data of the previous frame Fn−1 input from the frame memory 43 into a modulation data table, such as Table 1 or Table 2, to select modulated most significant bit data Mdata. Such modulated most significant bit data Mdata are added to a non-modulated least significant bit data LSB from a least significant bit output bus line 41 before output to a liquid crystal display. As shown in Table 1, a lookup table 44 compares the uppermost 4 bits, i.e., $2^4$, $2^5$, $2^6$ and $2^7$, of the previous frame Fn−1 with the uppermost 4 bits, i.e., $2^4$, $2^5$, $2^6$ and $2^7$, of the current frame Fn and selects a modulated data Mdata in accordance with the compared results.

When the most significant bit data are limited to have 4 bits, the lookup table 44 of a high-speed driving method is implemented as shown in the following Tables 1 or 2.

TABLE 1

| | 0 | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|---|
| 0 | 0 | 2 | 3 | 4 | 5 | 6 | 7 | 9 | 10 | 12 | 13 | 14 | 15 | 15 | 15 | 15 |
| 1 | 0 | 1 | 3 | 4 | 5 | 6 | 7 | 8 | 10 | 12 | 13 | 14 | 15 | 15 | 15 | 15 |
| 2 | 0 | 0 | 2 | 4 | 5 | 6 | 7 | 8 | 10 | 12 | 13 | 14 | 15 | 15 | 15 | 15 |
| 3 | 0 | 0 | 1 | 3 | 5 | 6 | 7 | 8 | 10 | 11 | 13 | 14 | 15 | 15 | 15 | 15 |
| 4 | 0 | 0 | 1 | 3 | 4 | 6 | 7 | 8 | 9 | 11 | 12 | 13 | 14 | 15 | 15 | 15 |
| 5 | 0 | 0 | 1 | 2 | 3 | 5 | 7 | 8 | 9 | 11 | 12 | 13 | 14 | 15 | 15 | 15 |
| 6 | 0 | 0 | 1 | 2 | 3 | 4 | 6 | 8 | 9 | 10 | 12 | 13 | 14 | 15 | 15 | 15 |
| 7 | 0 | 0 | 1 | 2 | 3 | 4 | 5 | 7 | 9 | 10 | 11 | 13 | 14 | 15 | 15 | 15 |
| 8 | 0 | 0 | 1 | 2 | 3 | 4 | 5 | 6 | 8 | 10 | 11 | 12 | 14 | 15 | 15 | 15 |
| 9 | 0 | 0 | 1 | 2 | 3 | 4 | 5 | 6 | 7 | 9 | 11 | 12 | 13 | 14 | 15 | 15 |
| 10 | 0 | 0 | 1 | 2 | 3 | 4 | 5 | 6 | 7 | 8 | 10 | 12 | 13 | 14 | 15 | 15 |
| 11 | 0 | 0 | 1 | 2 | 3 | 4 | 5 | 6 | 7 | 8 | 9 | 11 | 13 | 14 | 15 | 15 |
| 12 | 0 | 0 | 1 | 2 | 3 | 4 | 5 | 6 | 7 | 8 | 9 | 10 | 12 | 14 | 15 | 15 |
| 13 | 0 | 0 | 1 | 2 | 3 | 3 | 4 | 5 | 6 | 7 | 8 | 10 | 11 | 13 | 15 | 15 |
| 14 | 0 | 0 | 1 | 2 | 3 | 3 | 4 | 5 | 6 | 7 | 8 | 9 | 11 | 12 | 14 | 15 |
| 15 | 0 | 0 | 0 | 1 | 2 | 3 | 3 | 4 | 5 | 6 | 7 | 8 | 9 | 11 | 13 | 15 |

TABLE 2

| | 0 | 16 | 32 | 48 | 64 | 80 | 96 | 112 | 128 | 144 | 160 | 176 | 192 | 208 | 224 | 240 |
|---|---|---|---|---|---|---|---|---|---|---|---|---|---|---|---|---|
| 0 | 0 | 32 | 48 | 64 | 80 | 96 | 112 | 144 | 160 | 192 | 208 | 224 | 240 | 240 | 240 | 240 |
| 16 | 0 | 16 | 48 | 64 | 80 | 96 | 112 | 128 | 160 | 192 | 208 | 224 | 240 | 240 | 240 | 240 |
| 32 | 0 | 0 | 32 | 64 | 80 | 96 | 112 | 128 | 160 | 192 | 208 | 224 | 240 | 240 | 240 | 240 |
| 48 | 0 | 0 | 16 | 48 | 80 | 96 | 112 | 128 | 160 | 176 | 208 | 224 | 240 | 240 | 240 | 240 |
| 64 | 0 | 0 | 16 | 48 | 64 | 96 | 112 | 128 | 144 | 176 | 192 | 208 | 224 | 240 | 240 | 240 |
| 80 | 0 | 0 | 16 | 32 | 48 | 80 | 112 | 128 | 144 | 176 | 192 | 208 | 224 | 240 | 240 | 240 |
| 96 | 0 | 0 | 16 | 32 | 48 | 64 | 96 | 128 | 144 | 160 | 192 | 208 | 224 | 240 | 240 | 240 |
| 112 | 0 | 0 | 16 | 32 | 48 | 64 | 80 | 112 | 144 | 160 | 176 | 208 | 224 | 240 | 240 | 240 |
| 128 | 0 | 0 | 16 | 32 | 48 | 64 | 80 | 96 | 128 | 160 | 176 | 192 | 224 | 240 | 240 | 240 |
| 144 | 0 | 0 | 16 | 32 | 48 | 64 | 80 | 96 | 112 | 144 | 176 | 192 | 208 | 224 | 240 | 240 |
| 160 | 0 | 0 | 16 | 32 | 48 | 64 | 80 | 96 | 112 | 128 | 160 | 192 | 208 | 224 | 240 | 240 |
| 176 | 0 | 0 | 16 | 32 | 48 | 64 | 80 | 96 | 112 | 128 | 144 | 176 | 208 | 224 | 240 | 240 |
| 192 | 0 | 0 | 16 | 32 | 48 | 64 | 80 | 96 | 112 | 128 | 144 | 160 | 192 | 224 | 240 | 240 |
| 208 | 0 | 0 | 16 | 32 | 48 | 48 | 64 | 80 | 96 | 112 | 128 | 160 | 176 | 208 | 240 | 240 |
| 224 | 0 | 0 | 16 | 32 | 48 | 48 | 64 | 80 | 96 | 112 | 128 | 144 | 176 | 192 | 224 | 240 |
| 240 | 0 | 0 | 0 | 16 | 32 | 48 | 48 | 64 | 80 | 96 | 112 | 128 | 176 | 176 | 208 | 240 |

In Tables 1 and 2, the leftmost column is for a data voltage VDn−1 of the previous frame Fn−1 while an uppermost row is for a data voltage VDn of the current frame Fn. Table 1 shows lookup table information in which the most significant bits, i.e., $2^0$, $2^1$, $2^2$ and $2^3$, are expressed by the decimal number format. Table 2 shows look-up table information in which weighting values, i.e., $2^4$, $2^5$, $2^6$ and $2^7$ of the most significant 4 bits are applied to 8 bit data. Modulating only most significant bit data MSB of 4 bits reduces the memory capacity of the lookup table 44. However, the method of comparing 4 bits is problematic in that picture quality deteriorates for an uneven variation among grays and skips. For preventing deteriorating picture quality, the width of the modulated data on the lookup table 44 must be broad enough and input source data must be compared by unit of full bits, i.e., 8 bits.

Table 3 illustrates a lookup table, which has a modulated data of 8 bits and compares source data by unit of full bits of 8 bits.

TABLE 3

| Previous Frame \ Current Frame | 0 | 1 | ... | 141 | 142 | 143 | 144 | 145 | 146 | 147 | ... | 220 | 221 | 222 | 223 | 224 | 225 | 226 | ... | 255 |
|---|---|---|---|---|---|---|---|---|---|---|---|---|---|---|---|---|---|---|---|---|
| 0 | 1 | ... | 141 | 142 | 143 | 144 | 145 | 146 | 147 | ... | 220 | 221 | 222 | 223 | 224 | 225 | 226 | ... | 255 |
| 1 | 1 | ... | ... | ... | ... | ... | ... | ... | ... | ... | ... | ... | ... | ... | ... | ... | ... | ... | ... |
| ... | ... | ... | ... | ... | ... | ... | ... | ... | ... | ... | ... | ... | ... | ... | ... | ... | ... | ... | ... |
| 141 | ... | ... | 141 | 142 | 144 | 145 | 146 | 148 | 149 | ... | 244 | 245 | 246 | 247 | 248 | 248 | 249 | ... | 255 |
| 142 | ... | ... | 141 | 142 | 144 | 145 | 146 | 148 | 149 | ... | 244 | 245 | 246 | 247 | 248 | 248 | 249 | ... | 255 |
| 143 | ... | ... | 140 | 141 | 143 | 144 | 145 | 147 | 148 | ... | 244 | 245 | 246 | 247 | 248 | 248 | 249 | ... | 255 |
| 144 | ... | ... | 140 | 141 | 143 | 144 | 145 | 147 | 148 | ... | 244 | 245 | 246 | 247 | 248 | 248 | 249 | ... | 255 |
| 145 | ... | ... | 140 | 141 | 143 | 144 | 145 | 147 | 148 | ... | 244 | 245 | 246 | 247 | 248 | 248 | 249 | ... | 255 |
| 146 | ... | ... | 139 | 140 | 142 | 143 | 144 | 146 | 147 | ... | 244 | 245 | 246 | 247 | 248 | 248 | 249 | ... | 255 |
| ... | ... | ... | ... | ... | ... | ... | ... | ... | ... | ... | ... | ... | ... | ... | ... | ... | ... | ... | ... |
| 221 | ... | ... | 106 | 108 | 109 | 109 | 111 | 111 | 112 | ... | 220 | 221 | 223 | 225 | 226 | 227 | 228 | ... | 255 |
| 222 | ... | ... | 106 | 107 | 108 | 109 | 110 | 111 | 112 | ... | 219 | 220 | 222 | 224 | 225 | 227 | 228 | ... | 255 |
| 223 | ... | ... | 105 | 106 | 107 | 108 | 109 | 110 | 111 | ... | 218 | 220 | 222 | 223 | 225 | 227 | 228 | ... | 255 |
| 224 | ... | ... | 104 | 105 | 106 | 107 | 108 | 109 | 110 | ... | 216 | 218 | 220 | 222 | 224 | 226 | 227 | ... | 255 |
| 225 | ... | ... | 103 | 104 | 105 | 106 | 106 | 107 | 108 | ... | 215 | 217 | 219 | 221 | 222 | 223 | 227 | ... | 255 |
| 226 | ... | ... | 102 | 103 | 104 | 105 | 105 | 106 | 107 | ... | 213 | 215 | 217 | 220 | 221 | 224 | 226 | ... | 255 |
| ... | ... | ... | ... | ... | ... | ... | ... | ... | ... | ... | ... | ... | ... | ... | ... | ... | ... | ... | ... |
| 255 | ... | ... | 61 | 62 | 62 | 64 | 64 | 65 | 65 | ... | 155 | 156 | 157 | 158 | 162 | 165 | 168 | ... | 255 |

When the lookup table compares data by unit of full bits of 8 bits and has previously stored modulated data Mdata of 8 bits, the display quality is excellent for uneven variation of gray values, while a memory capacity rapidly increases. For example, if a lookup table compares data by unit of 8 bits and has modulated data Mdata of 8 bits, its memory capacity extends to 65536×8=524,288 bits. Accordingly, the first term 65536 of the left side is a product of 8-bit source data (256×256) in the previous frame Fn−1 and the current frame Fn, respectively. The second term, 8, is the width, 8 bits, of the modulated data on the lookup table 44. In order to implement red, green, and colors RGB, the lookup table needs a memory capacity of as much as 65536×8×3=1,572,864 bits. Accordingly, if the lookup table adopts an 8-bit comparison method for the high-speed driving, a chip size that stores the lookup table increases and manufacturing costs increase in accordance with the increases of the memory capacity.

SUMMARY OF THE INVENTION

Accordingly, the present invention is directed to a method of modulating data supply time, and a method and apparatus for driving liquid crystal display device using the same that substantially obviates one or more of the problems due to limitations and disadvantages of the related art.

An object of the present invention is to provide a method and apparatus for driving a liquid crystal display for reducing memory capacity and enhancing display quality.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a method of modulating data supply time includes steps of deriving a light transmittance versus time characteristic during a change of each gray level to another gray level in a liquid crystal display panel, deriving a transition time when each gray level is changed to another gray level on a basis of light transmittance versus time characteristic, and modulating a supply time of data supplied to the liquid crystal display panel in accordance with the transition time.

In another aspect, a driving method of a liquid crystal display device includes steps of receiving current data, delaying the current data, comparing the delayed current data with the received current data, and controlling a supply time of the data differently in accordance with a comparison result of the data.

In another aspect, a driving method of a liquid crystal display device includes the steps of receiving current data, delaying the current data, comparing the delayed current data with the received current data, selecting any one of an uppermost gray level data and a lowermost gray level data among gray level values of the data in accordance with a comparison result, and supplying the data selected between the uppermost gray level data and the lowermost gray level data to a liquid crystal display panel of the liquid crystal display device.

In another aspect, a driving apparatus of a liquid crystal display device includes a liquid crystal display panel of the liquid crystal display device, a lookup table for storing a transition time on a basis of a light transmittance versus time characteristic when each gray level is changed to another gray level in the liquid crystal display panel, and a time modulator for modulating a supply time of data supplied to the liquid crystal display panel in accordance with the transition time.

In another aspect, a driving apparatus of a liquid crystal display device includes a memory for delaying received current data, a lookup table comparing the delayed received current data with the received current data, and a controller for differently controlling a supply time of the data in accordance with a comparison result of the data.

In another aspect, a driving apparatus of a liquid crystal display device includes a memory delaying received current data, a lookup table for comparing the delayed received current data with the received current data, a selector for selecting any one of an uppermost gray level data and a lowermost gray level data among gray levels of the data in accordance with a comparison result, and a data supplier for supplying the data selected from the uppermost gray level data and the lowermost gray level data to a liquid crystal display panel of the liquid crystal display device.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
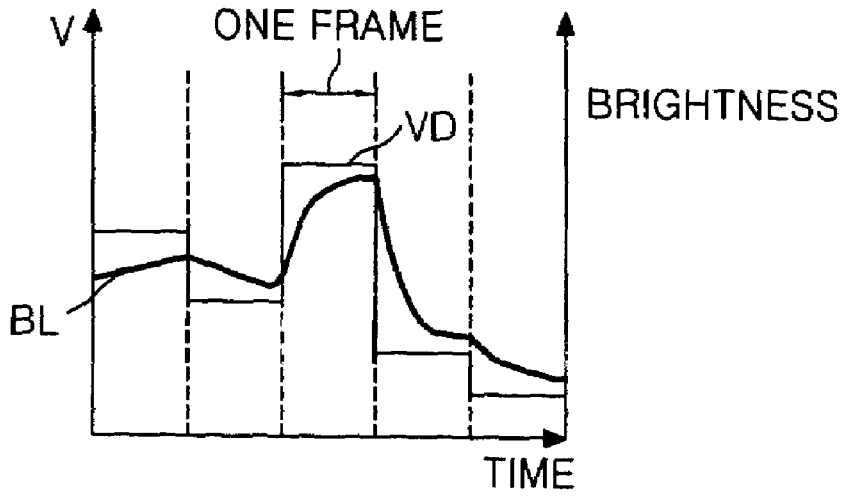
FIG. 1 RELATED ART
FIG. 1 is a waveform diagram of brightness variation in accordance with data in a liquid crystal display according to the related art.
Figure 2:
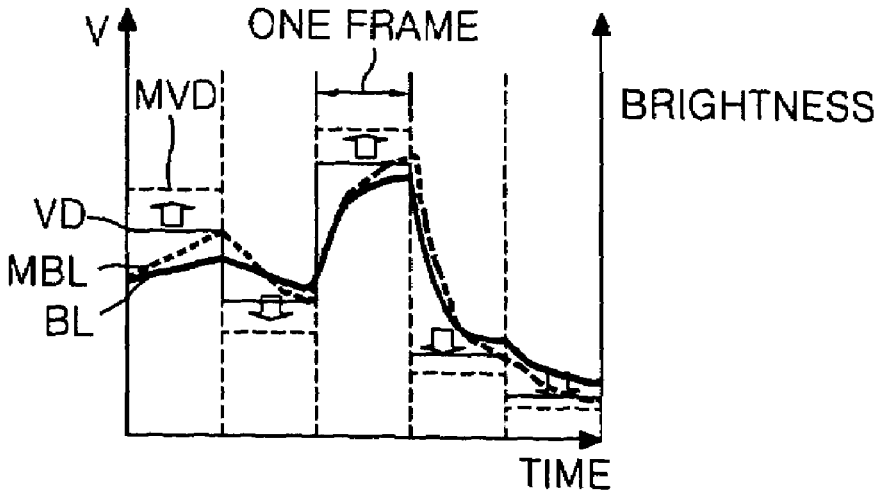
FIG. 2 RELATED ART
FIG. 2 is a waveform diagram of brightness variation in accordance with data modulation in a high-speed driving method according to the related art.
Figure 3:
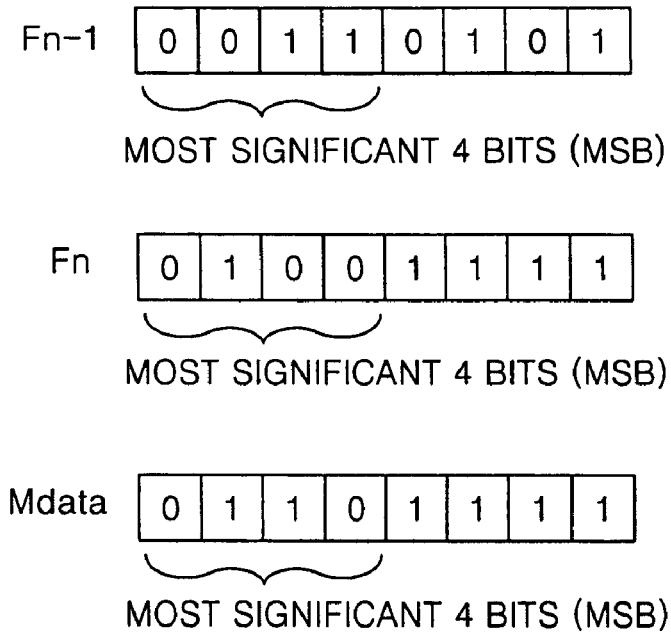
FIG. 3 RELATED ART
FIG. 3 is a diagram representing an example of the high speed driving method using 8-bit data according to the related art.
Figure 4:
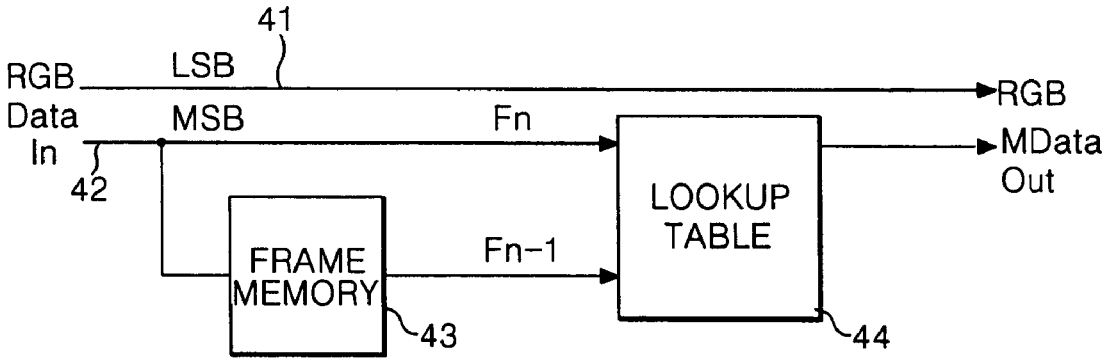
FIG. 4 RELATED ART
FIG. 4 is a block schematic diagram of a high-speed driving apparatus according to the related art.
Figure 5:
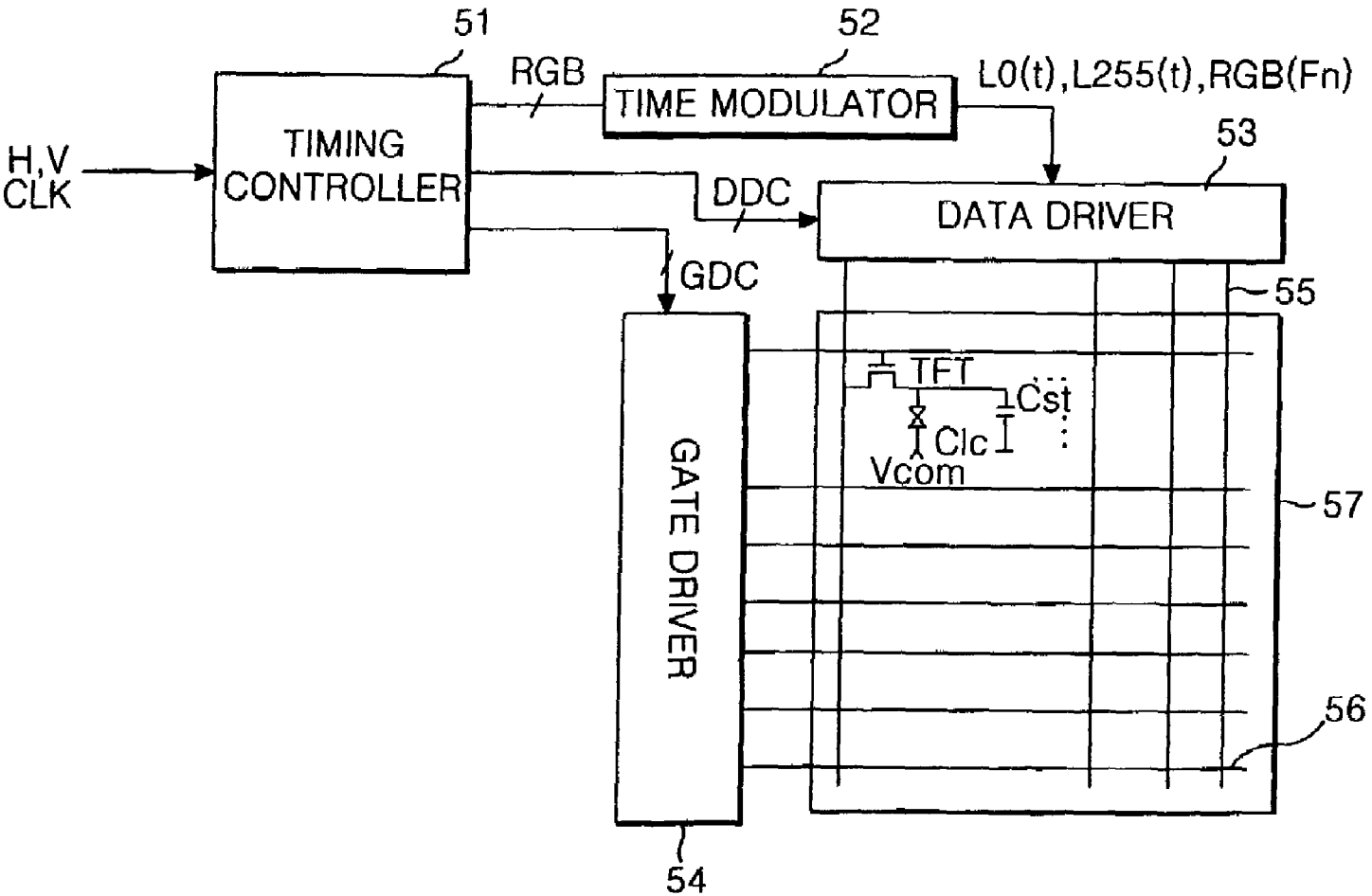
FIG. 5 is a schematic block diagram of an exemplary driving apparatus of a liquid crystal display according to the present invention.

FIG. 5 is a schematic block diagram of an exemplary driving apparatus of a liquid crystal display according to the present invention. In FIG. 5, a liquid crystal display may include a liquid crystal display panel 57 having a plurality of data lines 55 and gate lines 56 cross each other, and a TFT formed at each intersection part thereof to drive liquid crystal cells Clc, a data driver 53 to supply data to the data lines 55 of the liquid crystal display panel 57, a gate driver 54 to supply scan pulses to the gate lines 56 of the liquid crystal display panel 57, and a time modulator 52 connected to a timing controller 51 and the data driver 53.

The liquid crystal display panel 57 may include liquid crystals injected between two glass substrates and may have the data lines 55 and the gate lines 56 cross each other perpendicularly on a lower glass substrate thereof. The TFT provided at each intersection part of the data lines 55 and gate lines 56 supplies the data through the data lines 55 to the liquid crystal cell Clc. Accordingly, the gate electrode of the TFT may be connected to the gate line 56, the source electrode may be connected to the data line 55, and the drain electrode may be connected to a pixel electrode of the liquid crystal cell Clc. In addition, a storage capacitor Cst may be provided to sustain the voltage of the liquid crystal cell on the lower glass substrate of the liquid crystal display panel 57. The storage capacitor Cst may be formed either between the liquid crystal cell Clc connected to an $k^{th}$-numbered gate line 56 (k is a positive integer) and an $(k-1)^{th}$-numbered gate line, i.e., pre-stage gate line, or between the liquid crystal cell Cls connected to the $k^{th}$-numbered gate line 56 and a separate common line.

The data driver 53 may include a shift register to sample a dot clock of data control signals DDC, a register to temporarily store data, a latch to store the data by the line in response to the clock signal from the shift register and, at the same time, to output the stored data of one line, a digital-to-analog converter to select a positive/negative gamma voltage in response to a digital data value from the latch, a multiplexor to select the data line 55 supplied with an analog data that is converted by the positive/negative gamma voltage, and an output buffer connected between the multiplexor and the data line. The data driver 53 may receive data (L0(t), L255(t), RGB (Fn)) output from the time modulator 52 and may supply the (L0(t), L255(t), RGB (Fn)) to the data line 55 of the liquid crystal display panel 57 in response to the data control signals DDC received from the timing controller 51.

The gate driver 54 may include a shift register sequentially generating scan pulses in response to gate control signals GDC received from the timing controller 51, and a level shifter to shift the voltage of the scan pulse to a suitable level for driving the liquid crystal cell Clc. The gate driver 54 may supply the scan pulse to the gate line 56 to select the liquid crystal cells Clc of one horizontal line connected to the gate line 56. The data generated from the data driver 53 may be supplied to the liquid crystal cells CLc of the selected one horizontal line in synchronization with the scan pulse.

The timing controller 51 may generate gate control signals GDC to control the gate driver 54 in use of vertical/horizontal synchronization signals V and H and a clock CLK, and data control signals DDC to control the data driver 53. The timing controller 51 may supply digital video data RGB to the timing modulator 52 to control the operation timing of the time modulator 52.

The time modulator 52 may store the data RGB(Fn−1) input to the previous frame Fn−1 and may compare the previous frame data RGB(Fn−1) with the current frame data RGB(Fn) that are input. In addition, the time modulator 52 may output pre-set lowermost gray data L0(t) or uppermost gray data L255(t) instead of the data RGB(Fn) input in accordance with the comparison result if the current input data RGB(Fn) is higher or lower than the previous input data RGB(Fn−1) as in the following relational expressions (3) and (4). If the previous frame data RGB(Fn−1) is the same as the current frame data RGB(Fn), the timing modulator 52 may output the current input data RGB(Fn). In addition, the lower most gray data L0(t) or the uppermost gray data L255(t) output from the timing modulator 52 may vary in accordance to a transition time pre-derived on the basis of a characteristic of transmittance vs. time.

$$RGB(Fn)<RGB(Fn-1)\rightarrow L0(t) \quad (3)$$

$$RGB(Fn)<RGB(Fn-1)\rightarrow L255(t) \quad (4)$$

Figure 6:
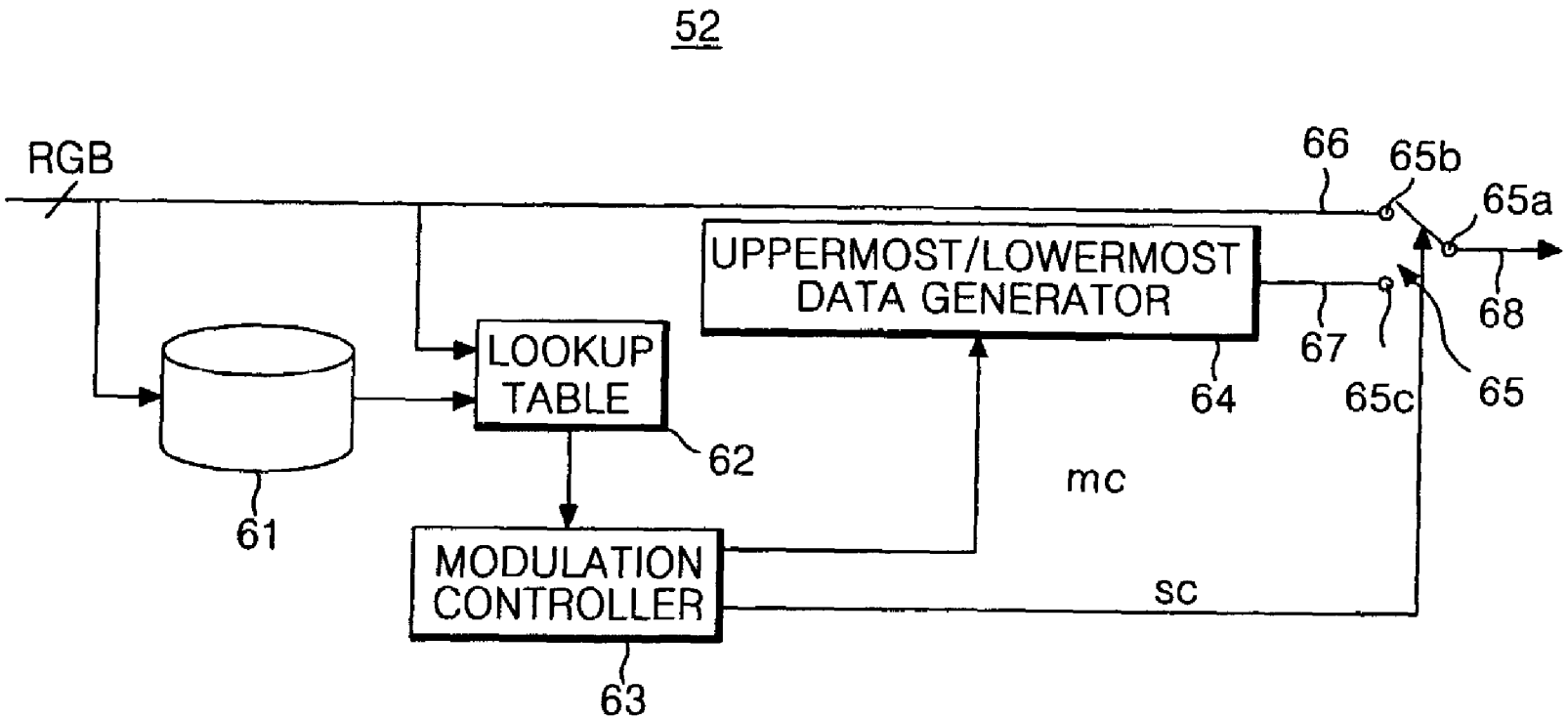
FIG. 6 is a schematic block diagram of an exemplary time modulator of FIG. 5 according to the present invention.

FIG. 6 is a schematic block diagram of an exemplary time modulator of FIG. 5 according to the present invention. In FIG. 6, the time modulator 52 may include a frame memory 61 to store the previous frame data RGB(Fn−1), a lookup table 62 to compare the previous frame data RGB(Fn−1) with the current frame data RGB(Fn), a modulation controller 63 provided between the lookup table 62 and the data driver 53, a uppermost/lowermost data generator 64, and a switch 65. The frame memory 61 may store data of one frame input from the timing controller 51, and may supply the stored previous frame data RGB(Fn−1) to the lookup table 61.

A first input terminal of the lookup table 62 may be connected to a data bus 66 to which digital video data RGB may be supplied from the timing controller 51, and a second input terminal may be connected to the output terminal of the frame memory 62. In addition, the output terminal of the lookup table 62 may be connected to the modulation controller 63. The lookup table 62 may store the value (t255) of an upward transition time when each gray level is changed to the uppermost gray level data L255(t) and the value (t0) of a downward transition time when each gray level is changed to the lower most gray level data L0(t).

Figure 7:
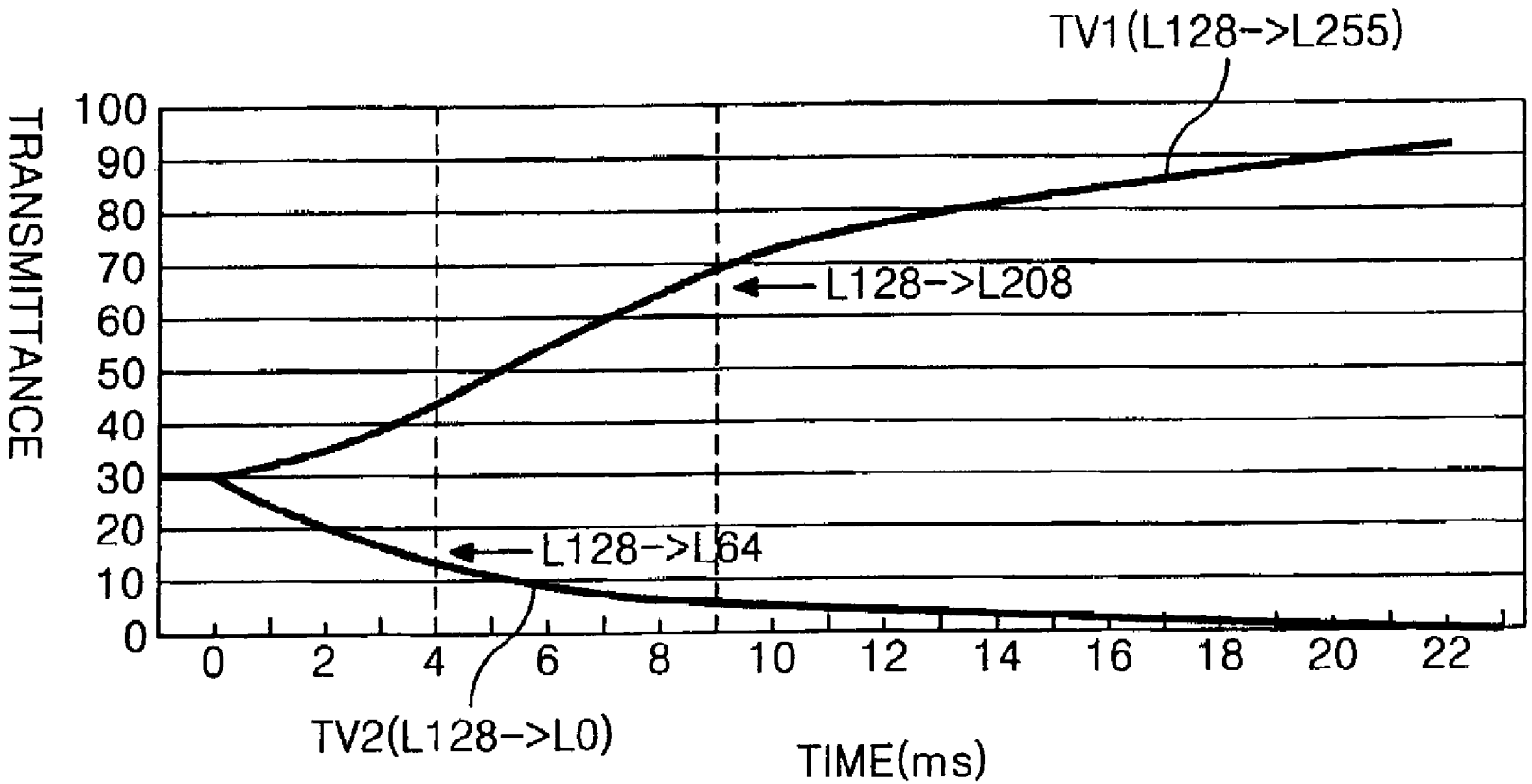
FIG. 7 is a graph showing an exemplary plot of transmittance vs. time according to the present invention.

FIG. 7 is a graph showing an exemplary plot of transmittance vs. time according to the present invention. In FIG. 7, the transition time values (t0, t255) may be derived on the basis of the transmittance vs. time graph. The transmittance vs. time graph represents the transmittance of a liquid crystal display panel changed in accordance with a voltage corresponding to each gray level when the liquid crystal display is driven at a drive frequency of 60 Hz and source data are 8-bit with which gray levels can be expressed from 0 to 255.

The upward transition time value (t255) may be based on the upward T-V curve (TV1) that flows from the transmittance of the middle gray level value 128 to the uppermost gray level value 255 in an expressible gray level range of 0~255. The upward transition time value (t255) may be derived by way of measuring a time when it reaches from each gray level to the uppermost gray level L255 on the upward T-V curve (TV1) when the current frame data RGB(Fn) is larger than the previous frame data RGB(Fn−1) as in the relational expressions (3) and (4).

The downward transition time value (t0) is based on the downward T-V curve (TV2) that flows from the transmittance of the middle gray level value '128' to the lowermost gray level value '0 '. The downward transition time value (t0) is derived by way of measuring a time when it reaches from each gray level to the lowermost gray level L0 on the downward T-V curve (TV2) when the current frame data RGB(Fn) is smaller than the previous frame data RGB(Fn−1) as in the relational expressions (3) and (4).

For example, as in FIG. 7 and Table 4, the upward transition value (t255) from a gray level value 128 to a gray level value 208 is 9 ms, and the downward transition value (t0) from a gray level value 128 to a gray level value 64 is 4 ms.

TABLE 4

| | 0 | 16 | 32 | 48 | 64 | 80 | 96 | 112 | 128 | 144 | 160 | 176 | 192 | 208 | 224 | 240 | 256 |
|---|---|---|---|---|---|---|---|---|---|---|---|---|---|---|---|---|---|
| 0 | 0 | 2 | 3 | 3 | 4 | 5 | 5 | 6 | 7 | 0 | 9 | 10 | 12 | −4 | 16 | 16 | 16 |
| 16 | 16 | 0 | 1 | 2 | 3 | 5 | 5 | 6 | 7 | 8 | 0 | 10 | 12 | −4 | 16 | 16 | 16 |
| 32 | 16 | 2 | 0 | 2 | 2 | 4 | 4 | 7 | 6 | 8 | 9 | 10 | 12 | −4 | 16 | 16 | 16 |
| 48 | 16 | 4 | 2 | 0 | 1 | 3 | 4 | 5 | 6 | 8 | 9 | 10 | 12 | −4 | 16 | 16 | 16 |
| 64 | 16 | 6 | 4 | 2 | 0 | 2 | 3 | 4 | 5 | 6 | 8 | 9 | 11 | −3 | 16 | 16 | 16 |
| 80 | 16 | 8 | 6 | 4 | 2 | 0 | 2 | 4 | 5 | 6 | 8 | 9 | 11 | −3 | 16 | 16 | 16 |
| 96 | 16 | 9 | 7 | 6 | 3 | 2 | 0 | 2 | 3 | 5 | 6 | 7 | 9 | −1 | 14 | 16 | 16 |
| 112 | 16 | 9 | 7 | 6 | 4 | 3 | 2 | 0 | 2 | 3 | 5 | 7 | 9 | −0 | 13 | 16 | 16 |
| 128 | 16 | −0 | 8 | 7 | 4 | 3 | 2 | 1 | 0 | 2 | 3 | 5 | 7 | 9 | 12 | 16 | 16 |
| 144 | 16 | −2 | 9 | 7 | 5 | 5 | 4 | 3 | 2 | 0 | 3 | 5 | 7 | 9 | 12 | 16 | 16 |
| 160 | 16 | −2 | 10 | 8 | 6 | 5 | 4 | 3 | 2 | 1 | 0 | 3 | 5 | 6 | 10 | 16 | 16 |
| 176 | 16 | −2 | 10 | 8 | 7 | 5 | 4 | 3 | 3 | 2 | 1 | 0 | 3 | 5 | 9 | 15 | 16 |
| 192 | 16 | −2 | 11 | 8 | 7 | 6 | 5 | 4 | 3 | 3 | 2 | 1 | 0 | 4 | 9 | 14 | 16 |
| 208 | 16 | −5 | 12 | 9 | 8 | 6 | 5 | 5 | 4 | 3 | 3 | 2 | 1 | 0 | 4 | 10 | 16 |
| 224 | 16 | −6 | 14 | 12 | 11 | 10 | 9 | 8 | 7 | 6 | 5 | 2 | 3 | 2 | 0 | 9 | 16 |
| 240 | 16 | −6 | 16 | 14 | 13 | 11 | −0 | 9 | 8 | 7 | 6 | 5 | 4 | 3 | 2 | 0 | 16 |
| 256 | 16 | −6 | 16 | 16 | 15 | 13 | −2 | −1 | 10 | 9 | 8 | 7 | 6 | 5 | 4 | 2 | 0 |

In Table 4, the leftmost column indicates the previous frame data RGB(Fn−1) and the uppermost row indicates the current frame data RGB(Fn). The transition time values (t0, t255) of Table 4 are stored at the lookup table 62. The lookup table 62 compares the previous frame data RGB(Fn−1) with the current frame data RGB(Fn) and outputs the downward transition time value (t0) corresponding thereto in accordance with the comparison result if the current frame data RGB(Fn) is smaller than the previous frame data RGB(Fn−1) as in the relational expressions (3) and (4). In addition, the lookup table 62 compares the previous frame data RGB(Fn−1) with the current frame data RGB(Fn) and outputs the upward transition time value (t255) corresponding thereto in accordance with the comparison result if the current frame data RGB(Fn) is bigger than the previous frame data RGB (Fn−1) as in the relational expressions (3) and (4).

The modulation controller 63 may control the uppermost/lowermost data generator 64 and a switch 65 in accordance with the transition time values (t0, t255) input from the lookup table 62. The modulation controller 63 may be provided in the timing controller 61. The uppermost/lowermost data generator 64 may output the uppermost gray level data L255(t) when the upward transition time value (t255) is output from the lookup table 62 in response to a memory control signal mc input from the modulation controller 63, whereas it outputs the lowermost gray level data L0(t) when the downward transition time value (t0) is output from the lookup table 62. Accordingly, the uppermost/lowermost data generator 64 may include a read-only-memory ROM to store the uppermost gray level data L255 and the lowermost gray level data L0, and a memory controller to output the data stored with the ROM in response to the memory control signal mc. The uppermost/lowermost data generator 64 may be provided in the timing controller 51.

An output terminal 65A of the switch may be connected to a data bus 68 that supplies the video data L0(t), L255(t), RGB(Fn) to the data driver 53. In addition, a first input terminal 65B of the switch 65 may be connected to a data bus 66 that receives the video data RGB(Fn) from the timing controller 51, and a second input terminal 65C may be connected to a data bus 67 that receives the uppermost gray level data L255 or the lowermost gray level data L0 from the uppermost/lowermost data generator 64.

The switch 65 may connect the second input terminal 65C to the output terminal 65A for supplying the uppermost gray level data L255 from the uppermost/lowermost data generator 64 to the data driver 53 in response to control signals (sc) received from the modulation controller 63 when the upward transition time value (t255) is output from the lookup table 62. Accordingly, if a time lapses as much as the upward transition time value (t255) selected by the lookup table 62, the switch 65 may connect the first input terminal 65B with the output terminal 65*a* for supplying the current frame data RGB(Fn) to the data driver 53. In addition, the switch 65 may connect the second input terminal 65C to the output terminal 65A for supplying the lowermost gray level data L0 received from the uppermost/lowermost data generator 64 to the data driver 53 in response to control signals (sc) from the modulation controller 63 when the downward transition time value (t0) is output from the lookup table 62. Accordingly, if a time lapses as much as the downward transition time value (t0) selected by the lookup table 62, the switch 65 may connect the first input terminal 65B with the output terminal 65*a* for supplying the current frame data RGB(Fn) to the data driver 53.

Figure 8:
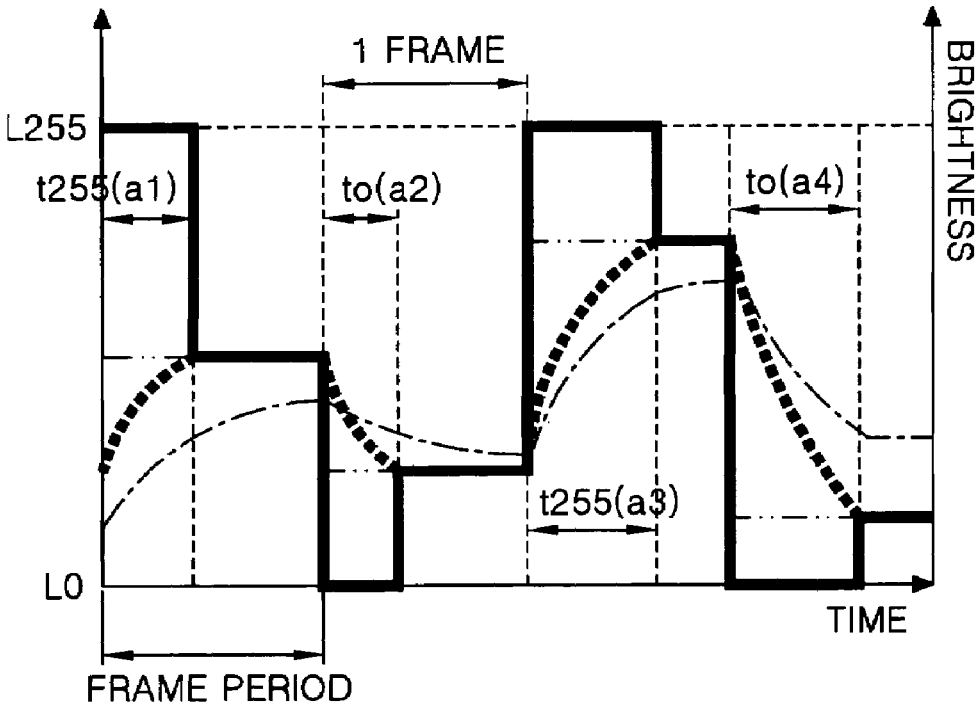
FIG. 8 is a graph showing comparative brightness variations between a liquid crystal cell according to the related art and an exemplary liquid crystal cell according to the present invention.

FIG. 8 is a graph showing comparative brightness variations between a liquid crystal cell according to the related art and an exemplary liquid crystal cell according to the present invention. In FIG. 8, the upward transition time values (t255(a1)) and (t255(a3)) of (a1) and (a3) may be determined differently in accordance with the extent by which the current frame data RGB(Fn) is larger than the previous frame data RGB(Fn−1). The uppermost gray level data (L255) may be supplied to the liquid crystal display panel 57 by as much as the upward transition time values (t255(a1)) and (t255(a3)). If the time indicated by the upward transition time values (t255(a1)) and (t255 (a3)) lapses, the current frame data RGB(Fn) having any one gray level value among the gray levels of 0~255 may be supplied to the liquid crystal display panel 57. Then, a voltage of the uppermost gray level data L255 , which is higher than the current frame data RGB(Fn) in absolute value, may be supplied to the liquid crystal cell Clc before the time indicated by the upward transition time values (t255(a1)) and (t255(a3)), and the brightness level of the liquid crystal cell Clc rises to the target brightness level of the current frame data RGB(Fn) by modulation of the supplying time before the time indicated by the upward transition time values (t255(a1)) and (t255 (a3)). In addition, the target brightness level may be sustained for the remaining frame period when the current frame data RGB(Fn) is supplied.

The downward transition time values (t0(a2)) and (t0(a4)) of (a2) and (a4) may be determined differently in accordance with the extent by which the current frame data RGB(Fn) is smaller than the previous frame data RGB(Fn−1). The lowermost gray level data (L0) may be supplied to the liquid crystal display panel 57 by as much as the downward transition time values (t0(a2)) and (t0(a4)). If the time indicated by the downward transition time values (t0(a2)) and (t0(a4)) lapses, the current frame data RGB(Fn) having any one gray level value among the gray levels of 0~255 may be supplied to the liquid crystal display panel 57. Then, a voltage of the lowermost gray level data L0, which are higher than the current frame data RGB(Fn) in absolute value, may be supplied to the liquid crystal cell Clc before the time indicated by the downward transition time values (t0(a2)) and (t0(a4)), and the brightness level of the liquid crystal cell Clc rises to the target brightness level of the current frame data RGB(Fn) by modulation of the supplying time before the time indicated by the downward transition time values (t0(a2)) and (t0(a4)). In addition, the target brightness level may be sustained for the remaining frame period when the current frame data RGB(Fn) is supplied.

Accordingly, the driving apparatus of the liquid crystal display according to the present invention may supply the data voltage lower or higher than the current frame data RGB(Fn) to the liquid crystal display panel 57 in accordance with the conditions of the relational expression (3) and (4). The driving apparatus also modulates the supply time of the data voltage in accordance with the time derived on the basis of transmittance vs. time characteristic, as in FIG. 7, thereby increasing the response time of the liquid crystal cell Clc.

Figure 9:
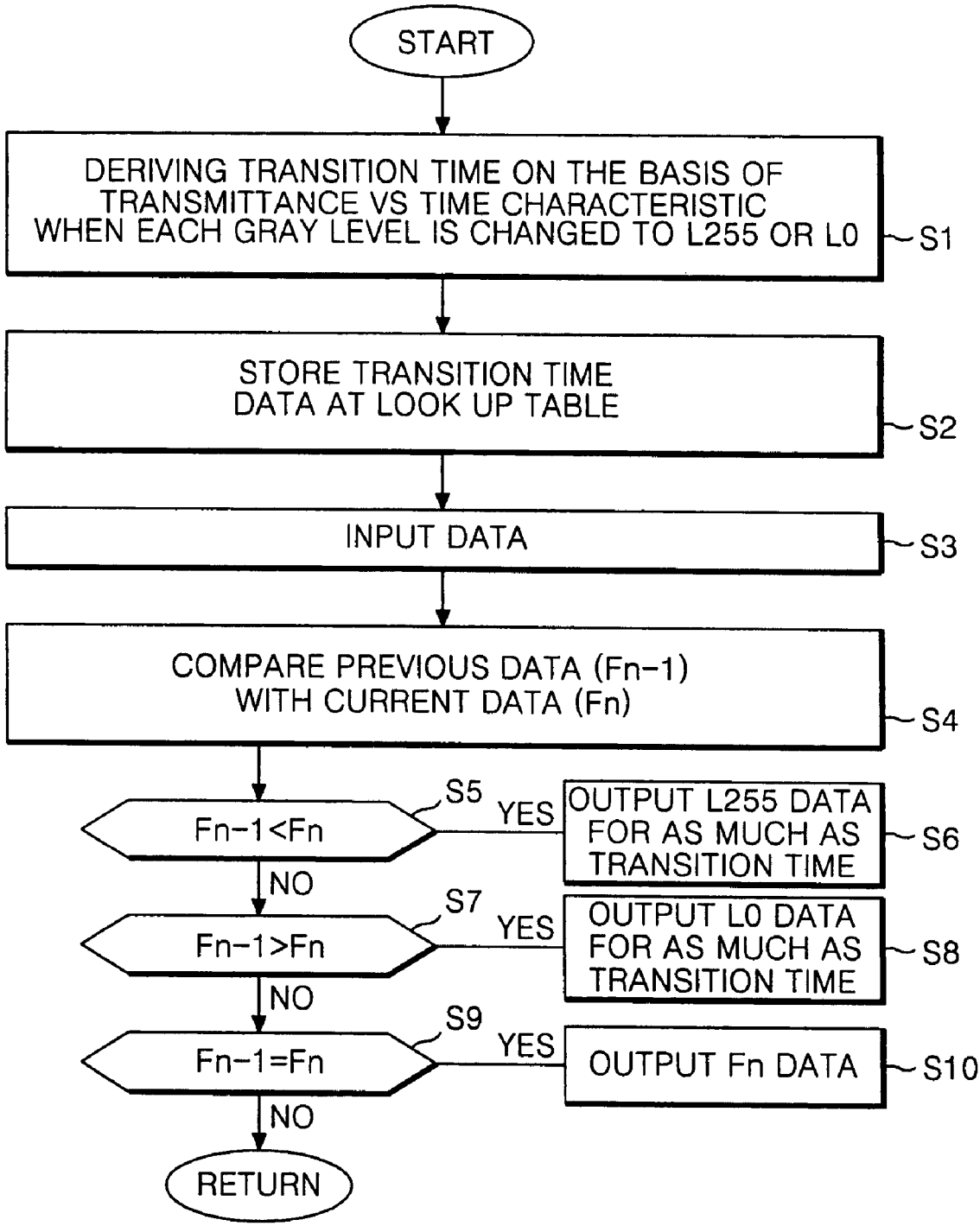
FIG. 9 is a flow chart showing an exemplary control sequence of a liquid crystal display according to the present invention.

FIG. 9 is a flow chart showing an exemplary control sequence of a liquid crystal display according to the present invention. At a step S1, a transition time may be measured when each gray level is changed to the uppermost gray level value (L255) or the lowermost gray level value (L0) on the basis of transmittance vs. time characteristic of the liquid crystal display, as in FIG. 7, to derive the transition time values (t255, t0) when each gray level is changed into another gray level value.

At a step S2, the transition time values (t255, t0) derived at a step S1 may be stored at a lookup table 62 of the time modulator 52.

At a step S3, if the data RGB are input to the liquid crystal display, the lookup table 62 compares the previous frame data RGB(Fn−1) with the current frame data RGB(Fn), and selects the pre-stored transition time values (t255, t0) if the comparison result satisfies the conditions of the relational expression (3) and (4).

At a step S4, based on the comparison result, if the current frame data RGB(Fn) is larger than the previous frame data RGB(Fn−1) in gray level value, as in the relational expressions (3) and (4), the uppermost gray level data (L255) may be supplied to the liquid crystal display panel 57 for as much as the upward transition time value (t255) that is selected by the lookup table 62, which is under control of the modulation controller 63 of the time modulator 52, steps S5 and S6.

At steps S7 and S8, as the comparison result of the step S4, if the current frame data RGB(Fn) is smaller than the previous frame data RGB(Fn−1) in gray level value, as in the relational expressions (3) and (4), the lowermost gray level data (L0) may be supplied to the liquid crystal display panel 57 for as much as the downward transition time value (t0) that is selected by the lookup table 62, which is under control of the modulation controller 63 of the time modulator 52.

At steps S9 and S10, as the comparison result of the step S4, if the current frame data RGB(Fn) is equal to the previous frame data RGB(Fn−1) in gray level value, the current frame data RGB(Fn) may be supplied intact to the liquid crystal display panel 57 under control of the modulation controller 63 of the time modulator 52.

It will be apparent to those skilled in the art that various modifications and variations can be made in the method of modulating data supply time and method and apparatus for driving liquid crystal display device using the same of the present invention without departing from the spirit or scope of the invention. Thus, it is intended that the present invention cover the modifications and variations of this invention provided they come within the scope of the appended claims and their equivalents.

What is claimed is:

1. A method of modulating data supply time, comprising the steps of:

deriving a light transmittance versus time characteristic during a change of each gray level to another gray level in a liquid crystal display panel;

deriving a transition time when each gray level is changed to another gray level on a basis of light transmittance versus time characteristic; and modulating a supply time of data supplied to the liquid crystal display panel in accordance with the transition time.

2. The method according to claim 1, wherein the step of deriving the transition time comprises:

deriving an upward transition time from a transmittance corresponding to a middle gray level value to a transmittance corresponding to an uppermost gray level value in an expressible gray level range; and deriving a downward transition time from the transmittance corresponding to the middle gray level value to a transmittance corresponding to a lowermost gray level value in the expressible gray level range.

3. The method according to claim 2, further comprising the step of determining an extent of variation of the data input to the liquid crystal display panel.

4. The method according to claim 3, further comprising the step of selecting any one of the upward transition time and the downward transition time in accordance with the extent of variation of the data input to the liquid crystal display panel.

5. The method according to claim 3, wherein the step of modulating the supply time of the data comprises modulating the supply time of the data in accordance with the transition time selected from the upward transition time and the downward transition time.

6. A driving method of a liquid crystal display device, comprising the steps of:

receiving current data;

delaying the current data;

comparing the delayed current data with the received current data;

deriving a light transmittance vs. time characteristic when each gray level is changed to another gray level in a liquid crystal display panel of the liquid crystal display device;

deriving an upward transition time from a transmittance corresponding to a middle gray level value to a transmittance corresponding to an uppermost gray level value in an expressible gray level range of the liquid crystal display panel deriving a downward transition time from the transmittance corresponding to the middle gray level value to a transmittance corresponding to a lowermost gray level value in the expressible gray level range; and selecting any one of the upward transition time and the downward transition time in accordance with the comparison result of the data; and modulating a supply time of the data in accordance with a transition time selected from the upward transition time and the downward transition time.

7. A driving method of a liquid crystal display device, comprising the steps of:

receiving current data;

delaying the current data;

comparing the delayed current data with the received current data;

selecting any one of an uppermost gray level data and a lowermost gray level data among gray level values of the data in accordance with a comparison result;

supplying the data selected between the uppermost gray level data and the lowermost gray level data to a liquid crystal display panel of the liquid crystal display device;

deriving an upward transition time from a transmittance corresponding to a middle gray level value to a transmittance corresponding to an uppermost gray level value in an expressible gray level range of the liquid crystal display panel;

deriving a downward transition time from the transmittance corresponding to the middle gray level value to a transmittance corresponding to a lowermost gray level value in the expressible gray level range;

selecting any one of the upward transition time and the downward transition time in accordance with the comparison result; and modulating a supply time of the data in accordance with a transition time selected from the upward transition time and the downward transition time.

8. A driving apparatus of a liquid crystal display device, comprising:

a liquid crystal display panel of the liquid crystal display device;

a lookup table for storing a transition time on a basis of a light transmittance versus time characteristic when each gray level is changed to another gray level in the liquid crystal display panel; and a time modulator for modulating a supply time of data supplied to the liquid crystal display panel in accordance with the transition time.

9. A driving apparatus of a liquid crystal display device, comprising:

a memory for delaying received current data;

a lookup table comparing the delayed received current data with the received current data; and a controller for differently controlling a supply time of the data in accordance with a comparison result of the data;

wherein the lookup table stores;

an upper transition time from a transmittance corresponding to a middle gray level value to a transmittance corresponding to an uppermost gray level value in an expressible gray level range; and a downward transition time from the transmittance corresponding to the middle gray level value to a transmittance corresponding to a lowermost gray level value in the expressible gray level range.

10. The driving apparatus according to claim 9, wherein the lookup table selects any one of the upward transition time and the downward transition time in accordance with the comparison result of the data.

11. The driving apparatus according to claim 10, wherein the controller modulates a supply time of the data in accordance with the selected transition time.

12. A driving apparatus of a liquid crystal display device, comprising:

a memory delaying received current data;

a lookup table for comparing the delayed received current data with the received current data;

a selector for selecting any one of an uppermost gray level data and a lowermost gray level data among gray levels of the data in accordance with a comparison result;

a data supplier for supplying the data selected from the uppermost gray level data and the lowermost gray level data to a liquid crystal display panel of the liquid crystal display device; and a controller for differently controlling a supply time of the data in accordance with the comparison result;

wherein the lookup table stores;

an uppermost transition time from a transmittance corresponding to a middle gray level value to a transmittance corresponding to an uppermost gray level value in an expressible gray level range of the liquid crystal display panel and a downward transition time from the transmittance corresponding to the middle gray level value to a transmittance corresponding to a lowermost gray level value in the expressible gray level range.

13. The driving apparatus according to claim 12, wherein the lookup table selects any one of the upward transition time and the downward transition time in accordance with the comparison result.

14. The driving apparatus according to claim 13, wherein the controller modulates a supply time of the data in accordance with a transition time selected from the upward transition time and the downward transition time.

* * * * *